US010767595B2

(12) United States Patent
Maisotsenko

(10) Patent No.: US 10,767,595 B2
(45) Date of Patent: Sep. 8, 2020

(54) POWER GENERATION USING ENTHALPY DIFFERENCE GRADIENT FOR SUBATMOSPHERIC REGENERATIVE PISTON ENGINE

(71) Applicant: M-Cycle Corporation Ltd., Denver, CO (US)

(72) Inventor: Valeriy Stepanovich Maisotsenko, Centennial, CO (US)

(73) Assignee: M-Cycle Corporation Ltd., Denver, CO (US)

( * ) Notice: Subject to any disclaimer, the term of this patent is extended or adjusted under 35 U.S.C. 154(b) by 0 days.

(21) Appl. No.: 16/342,634

(22) PCT Filed: Oct. 18, 2016

(86) PCT No.: PCT/IB2016/001581
§ 371 (c)(1),
(2) Date: Apr. 17, 2019

(87) PCT Pub. No.: WO2018/073614
PCT Pub. Date: Apr. 26, 2018

(65) Prior Publication Data

US 2019/0234341 A1 Aug. 1, 2019

(51) Int. Cl.
*F02G 1/02* (2006.01)

(52) U.S. Cl.
CPC ..... *F02G 1/02* (2013.01)

(58) Field of Classification Search
CPC ..... F02G 1/02; E05B 63/244; Y10S 292/23; Y10S 292/40; Y10T 292/0994; Y10T 292/688
See application file for complete search history.

(56) References Cited

U.S. PATENT DOCUMENTS 4,414,812 A * 11/1983 Parry ..... F02G 1/02 60/641.14
4,630,447 A * 12/1986 Webber ..... F02B 41/06 60/516
4,653,269 A * 3/1987 Johnson ..... F02G 1/00 60/39.63

(Continued)

FOREIGN PATENT DOCUMENTS

CN 102459889 A 5/2012
DE 102005053857 A1 5/2007

(Continued)

OTHER PUBLICATIONS

Written Opinion of the International Searching Authority dated Apr. 26, 2018 in parent International application PCT/IB2016/001581.

(Continued)

*Primary Examiner* — Jesse S Bogue
(74) *Attorney, Agent, or Firm* — Aleksandr Smushkovich

(57) ABSTRACT

A method for power generation via a liquid-gas phase transition. The method includes receiving atmospheric air as input to create an enthalpy difference gradient. A regenerative piston engine received atmospheric air. The regenerative piston engine collects heat generated from the enthalpy difference gradient. The regenerative piston engine converts the collected heat to a mechanical form of energy at the regenerative piston engine.

8 Claims, 6 Drawing Sheets

(56) References Cited

U.S. PATENT DOCUMENTS

| | | | | |
|---|---|---|---|---|
| 5,050,391 | A * | 9/1991 | Tsimerman | F24F 3/1411 62/94 |
| 5,074,110 | A * | 12/1991 | Singh | F01K 21/02 60/39.54 |
| 6,886,326 | B2 * | 5/2005 | Holtzapple | F01C 1/103 60/39.6 |
| 9,797,339 | B2 * | 10/2017 | Evans | F01C 1/08 |
| 9,982,626 | B2 * | 5/2018 | Rabhi | F02M 25/028 |
| 2011/0296822 | A1 | 12/2011 | Bollinger et al. | |
| 2013/0180243 | A1 | 7/2013 | Hurtado | |
| 2015/0033724 | A1 | 2/2015 | Fong et al. | |
| 2018/0363535 | A1 * | 12/2018 | Andersson | F01N 3/2066 |

FOREIGN PATENT DOCUMENTS

| | | | |
|---|---|---|---|
| JP | 2010101233 | A | 5/2010 |
| WO | 2018046979 | A1 | 3/2018 |

OTHER PUBLICATIONS

International Search Report dated Apr. 26, 2018 in parent International application PCT/IB2016/001581.

* cited by examiner

POWER GENERATION USING ENTHALPY DIFFERENCE GRADIENT FOR SUBATMOSPHERIC REGENERATIVE PISTON ENGINE

FIELD OF THE INVENTION

This application relates generally to power generation. More specifically, this application relates to the use of a liquid-gas phase transition through the new evaporative cooling process and thermal regeneration for recovery sensible and latent heat to maintain high enthalpy difference gradient in power generation.

Also this invention relates more particularly to the subatmospheric regenerative piston engine (for example double-acting piston engine), in which hot gases as working fluids are expanded from a pressure near atmospheric pressure to a pressure substantially below atmospheric pressure, and then condensed, and compressed back to atmospheric pressure.

BACKGROUND

The use of thermodynamic techniques for converting heat energy into mechanical, electrical, or some other type of energy has a long history. The basic principle by which such techniques function is to provide a large temperature differential (or the high enthalpy difference gradient) across a thermodynamic engine and to convert the heat represented by that temperature differential into a different form of energy.

Aspects of the invention use atmospheric air as resource of renewable energy through the unique evaporative cooling process to create the enthalpy difference gradient for producing power through the regenerative piston engine. The basic operating principles of the embodiments of the invention involve simultaneously utilizing atmospheric air and water and as its phase changing in the subatmospheric thermodynamic cycle using for it of small account of heat.

The known process of evaporation in dry air permits one, in theory, to extract energy by an «atmospheric engine» from atmospheric air (the water-air system) in form of useful work through difference temperatures or enthalpy difference. One such «atmospheric engine» is a simple toy called the "drinking bird" that can be found in almost any novelty shop. This engine is a closed cycle condensing heat engine and uses the ambient environment as its high temperature heat reservoir; it operates by generating an artificial low temperature heat reservoir by evaporating water. The "drinking bird" heat engine operates on the temperature difference between the ambient temperature (dry bulb) and the wet bulb temperature of outside air. When the "bird" is in the vertical position and the head is wet, vapor in the warmer lower bulb forces fluid up to the cool head through a tube. As the head gets full, the bird gets top-heavy and topples into the horizontal position. In this position, the lower end of the aforementioned tube comes out of the liquid, permitting the head to drain and hence the bird to right itself and repeat the cycle.

The basic thermodynamic operating principles of this "drinking bird" heat engine were analyzed by Carl Bachhuber in his paper, "Energy from the Evaporation of Water," American Journal of Physics, Vol. 51, No. 3, March 1983, pp. 259-264. In particular, Bachhuber has shown that ordinary water can be used to extract an unlimited amount of natural thermal energy from the surrounding environment by creating enthalpy difference gradient and convert it into mechanical work. Moreover, the specific energy of the water evaporative process than can be converted into useful mechanical work by this «atmospheric engine» is approximately twice the specific energy available in automotive storage batteries. In a technical report: «A Simple Heat Engine of Possible Utility in Primitive Environments», Rand Corporation Publication No. P-3367 (August 1966), Richard Murrow proposed constructing larger versions of this «atmospheric engine» for pumping water from the Nile River. A scaled up model of the basic drinking bird engine was constructed to a height of seven feet and found to be able to generate considerable mechanical work. (See, "The Research Frontier—Where is Science Taking Us," Saturday Review, Vol. 50, Jun. 3, 1967, pp. 51-55, by Richard Murrow.) Obviously, engines such as these are not "perpetual motion machines." In principle, larger engines of this type could be used to propel ocean going vessels indefinitely using ordinary sea water for generating an unlimited amount of mechanical work. Although this possibility is generally believed to be thermodynamically impossible, it is clearly not impossible. The existence of these «atmospheric engine» proves that it is indeed possible to convert natural heat energy of the environment at ambient temperature into an unlimited amount of mechanical work by creating an artificial low temperature heat reservoir below ambient through the evaporative cooling process.

The "atmospheric engine" disclosed herein is a semi-open cycle, multi-stage, heat engine that also converts natural ambient heat energy of the environment into mechanical work but uses ordinary air instead of water to create an artificial low temperature heat reservoir. Since air is universally available all over the Earth, the atmospheric engine will be much more practical than the drinking bird engine. It will be shown that the specific energy of air that can be converted into mechanical work by the atmospheric engine is much higher than the specific energy of water used in the drinking bird engine. Hence, the disclosed atmospheric engine will be much more powerful than the drinking bird engine. Since the disclosed atmospheric engine is not a closed cycle engine and operates, as in the case of the drinking bird engine, by generating the enthalpy difference gradient through an artificial low temperature heat reservoir below ambient by evaporative cooling process, it does not violate the second law of thermodynamics.

A team of bioengineers led by Ozgur Sahin at Columbia University have just created the world's first evaporation-driven engine. This method and system for providing an engine for producing mechanical energy through the condensation and evaporation of moisture uses a hygroscopic material in one or more configurations to do mechanical work. The hygroscopic material can include microbial spores or other materials that absorb moisture and expand or swell when exposed to high relative humidity environments and shrink or return to nearly their original size or shape when exposed to low relative humidity environments wherein the moisture evaporates and is released. But this engine is as the slight toy (less than four inches) and has small thermal efficiency, because it uses only of the known tiny temperature gradients between dry bulb and wet bulb temperatures.

Although these particular designs for extracting work from the water-air system may be impractical, the theoretical limit for the work that can be extracted from the water-air system is impressive if the air is hot and dry. At 10% relative humidity and body temperature, the available energy per unit mass of water is about twice the available energy per unit mass of an automotive battery.

The known "atmospheric engines" aren't thermal efficient because they operate on the temperature difference between the ambient temperature (dry bulb) and the wet bulb temperature of outside air. Usually theses difference temperatures are small magnitudes which are defined of small degreases of the enthalpy difference gradients for power (work) generation through engines.

The output work of any engine can be significantly increased by using the Maisotsenko Cycle (see «Life below the wet bulb: The Maisotsenko cycle», POWER, November/December 2003, pp. 29-31). The Maisotsenko Cycle operates on the larger temperature difference between the ambient temperature (dry bulb) and the dew point temperature, (not the wet bulb temperature) of outside air. Therefore it is possible to create higher degreases of the enthalpy difference gradients for power (work) generation through the piston engines.

Typically, the heat differential is provided by hydrocarbon combustion, although the use of other techniques is known. Using such systems, power is typically generated with an efficiency only of about 30%, although some internal-combustion engines have efficiencies as high as 50% by running at very high temperatures and pressure. The efficiency of the existing running combustion engines to convert heat from the ambient environment into the mechanical form of energy may sometimes be less than 10%.

It is well known that one of the disadvantages of presently known combustion engines is inefficiency. Another problem is the requirement of materials which will not only withstand high pressures but also high pressures at high temperatures, particularly in gases and combustion products which tend to be corrosive. Efforts to overcome these problems usually result in solutions involving considerable cost penalties, so that efficient combustion engines remain unavailable to the general public.

Conversion of heat into mechanical energy is typically achieved using the piston engines like an Otto, Diesel or Stirling engines, which implement a Carnot cycle to convert the thermal energy. The mechanical energy may subsequently be converted to electrical energy using any of a variety of known electromechanical systems.

Conventional Otto and Diesel cycle piston engines operate by in taking fresh air, compressing the air, burning fuel with the air to produce high temperature, high pressure combustion products, expanding the combustion products to convert part of the heat into work, and then exhausting the spent gases. These engine cycles are relatively inefficient in converting heat into work because of the practical limitations on the extent of the compression and expansion processes. In order to operate at the highest efficiency which is theoretically possible, the hot product gases would need to be expanded until they had cooled to room temperature. However, with the thermal properties of ordinary combustion products, this would require an expansion volume ratio in excess of one thousand. Those skilled in the art will be aware that an engine with a volume expansion ratio of one thousand and a final gas pressure at or near atmospheric would require a peak pressure so high as to threaten destruction of cylinder, piston and other moving parts, and would aggravate losses from friction, heat transfer, and gas leakage. Also using high temperatures and high pressure for conventional power cycles, this leads to the significant irreversible losses which greatly reduce the thermal efficiency of these power systems.

The embodiments of the invention use the renewable energy to create of the high enthalpy difference gradient of the working fluid for producing power through the double-acting piston engine. Energy conversion system for deriving of useful power by the double-acting piston engine from sources of renewable energy was proposed in 1979 by Charles Jahnig through the U.S. Pat. No. 4,170,878. However, this engine requires enormous surface areas because the operation inherently has very low conversion efficiency, typically 3 to 5%, and so enormous amounts of heat must be transferred. Moreover, this heat must be transferred at very small temperature differences, such as 2° F. to 5° F. Therefore this double-acting piston engine has small thermal efficiency because it cannot create of the high enthalpy difference gradient of the working fluid.

The embodiments of the invention use atmospheric air as resource of renewable energy through the unique evaporative cooling process to create enthalpy difference gradient for producing power. The first time the direct evaporative cooling process was proposed for the piston Stirling engine by Cool Energy Inc in 2007 through the U.S. Pat. No. 7,694,514. Here a hot water is injected into the working fluid in a working space of a hot region and cold water is injected in a working space of a cold region of the piston Stirling engine. Therefore realize better isothermal heat addition and heat rejection processes within the piston Stirling engine. The most interesting conception through the evaporative cooling process for the piston Stirling engine was proposed by Weavers through the U.S. Pat. No. 7,810,330: "Power generation using thermal gradients maintained by phase transitions". It makes use of water-air phase transitions through the direct evaporative cooling process to maintain a thermal gradient in driving an engine to convert the heat into mechanical energy in power-generation applications. These known evaporative cooling technologies have increased thermal efficiency of the piston engine only about 1.5-2%.

A very promising technique for substantially increasing the thermal efficiency of a combustion piston engines is through thermal regeneration. Thermal regeneration, as used herein, implies the capture of exhaust gas heat from one engine cycle and the transfer of this heat to the working fluid of the subsequent cycle following its compression, but prior to the combustion of the fuel, so as to reduce the required quantity of fuel to be burned. A number of attempts have been made to devise means by which regenerative features similar to those employed in the piston Stirling or Ericsson type engine could be used to accomplish this. Most notable of these piston techniques are those of Hirsch (1874, U.S. Pat. No. 155,087), Martinka (1937, U.S. Pat. No. 2,239,922), Pattas (1973, U.S. Pat. No. 3,777,718), Bland (1975, U.S. Pat. No. 3,871,179), Pfefferle (1975, U.S. Pat. No. 3,923,011), Cowans (1977, U.S. Pat. No. 4,004,421), and Stockton (1978, U.S. Pat. No. 4,074,533).

Analyses of regenerative engine cycles show that the idealized thermodynamic thermal efficiency increases when the compression ratio is decreased, however the cycle mean effective pressure and specific power output decreases as the compression ratio is decreased. Since an engine with low cycle effective pressure must be larger for a given power output, and since heat conduction losses and friction losses increase with engine size, an optimum design must have an intermediate value for compression ratio, i.e. it must be low enough to give acceptable thermodynamic efficiency, but high enough to give low heat conduction and friction losses.

All conventional regenerator designs are the same, or very similar Usually they are the plate or shall and tube heat exchangers, where there is the heat exchange mechanism through surface between the hot and cold working fluids. Heat exchange process between these fluids (usually it is air or gas or their mix) is so small but pressure drop is pretty big. This is explained that those working fluids for any existing engines are one phase flows, which don't change their state of aggregation during of implementation of the power cycle, always remaining in the gas phase.

A prior art, an example of the atmospheric combustion engine is disclosed in the Japanese patent, JP 2002-242700 A. Here expands a high-temperature gas of the atmospheric pressure produced by atmospheric combustion, recovers heat from the gas by a regenerative heat exchanger and a cooler, and sucks, pressurizes and discharges the gas by a compressor. Latter this atmospheric combustion engine was improved by Tanaka (see U.S. Pat. No. 7,204,077) increasing of the power generating efficiency from 28, 1% to 33, 5%. But anyway this system is so complicated and not enough efficient.

Some atmospheric combustion engines have been proposed for increasing of the power generating efficiency. For example, such solar thermally driven power system comprises a solar air heater for focusing solar radiation. Air within the solar heater is heated generally at atmospheric pressure by heat absorption and the heated air is supplied through a humidifying air recuperator to a rotatable turbine of an atmospheric pressure turbine system as a power generating device. This power system, using solar energy, can be realized only together with a rotatable turbine.

Therefore, the existing piston power generation methods and engines are not thermal efficient and cannot be realized for the regenerative piston engine. The known piston power systems and engines don't provide a means through the Maisotsenko Cycle for humidifying and heating of the airflow for the expansion process of the regenerative piston engine in a thermodynamically efficient manner and consequently cannot guarantee small level of density through high level of moisture and temperature for this air. It is known that airflow with higher absolute humidity and temperature (high enthalpy) for the expansion process increases the thermal efficiency of the piston engine. Besides, the known piston power systems cannot guarantee a high level of density through small absolute humidity and temperature for this airflow, using efficient cooling process. It is known that airflow with a small absolute humidity and temperature (small enthalpy) for the compression process increases the thermal efficiency of the piston engine.

Difference of enthalpies (or difference of densities) of the working fluid are a driving force for the proposed subatmospheric regenerative piston engine. Enthalpy change or enthalpy difference gradient is the name given to the amount of heat evolved or absorbed in a reaction carried out at constant pressure. It is given the symbol $\Delta H$, read as "delta H". It is known from thermodynamics for any adiabatic process the technical or mechanical work (W) done by engine is enthalpy difference ($\Delta H$) of the working fluid at the beginning (H1) and end (H2) of the process: $W=H1-H2=\Delta H$. Thereby growing of a value of enthalpy difference ($\Delta H$) this leads increasingly to boost of the mechanical work (W) done by engine and hence to increasing of the thermal efficiency of a power engine.

SUMMARY

Aspects of the invention include a method for power generation, using enthalpy difference gradient for the subatmospheric regenerative piston engine (SRPE), offers important advantages by the creation of a significant value of enthalpy difference for the working fluid, rewarding efficiency and low-cost comparing with existing technologies. Herewith using the subatmospheric simple power cycle, it is possible to achieve thermal efficiency of more than 70% for the proposed piston engine.

Embodiments of the invention provide method for power generation using of the enthalpy difference gradient and the SRPE from ambient environment (outside air) through consuming of the new evaporative cooling process and thermal regeneration simultaneously. The SRPE is disposed in an ambient environment, where outside air (along with fuel) is renewable source of energy.

Renewable resource of energy is critical to the future of our planet. The psychrometric energy (energy from air) obtained through an efficient heat recovery process known as the Maisotsenko Cycle (herein further referred to as 'M-Cycle', e.g., see: "Maisotsenko cycle for cooling process", Clean Air, Vol. 9, pp. 1-18, 2008 Copyright—2008 by Begell House, Inc.) can operate in synergy with the proposed SRPE. Together, they could provide an efficient solution for power generation by a piston engine with high thermal efficiency and minimum pollution.

This efficient solution for power generation is provided for embodiments of the invention by creating and using of the high enthalpy difference gradient of the working fluid for producing power through the unique M-Cycle technology.

Embodiments of the invention through the M-Cycle may realize more thermally efficient process by cooling the working fluid to near its dew point in the product channels, and humidifies saturated working fluid in its wet channels. This is in preparation for cooling and condensing water from the working fluid before its compression process and further heating and humidifying the saturated working fluid before its expansion process.

Another embodiment of the invention provides SRPE of extremely high thermal efficiency, approaching the Carnot theoretical cycle efficiency.

The high thermal efficiency even compared to the Carnot cycle may be explained by fundamental differences. The Carnot cycle uses only one working fluid, coming through the following stages: compression—heating (combustion)—expansion—cooling. The embodiments of the invention through the M-Cycle employs two different working fluids: first—the cold and dehumidified airflow (small enthalpy) for compression process and second—the saturated, heated and humidified airflow (high enthalpy) for expansion process. Ideally, therefore it increases more the thermal efficiency for the proposed piston engine.

Application of two different working fluids provides some important advantages. As the moisture is added into airflow for expansion process, to retain the same mass flow rate as for the traditional engine, one necessary to press less amount of air, i.e. the necessary power for compressing process is reduced compared to the traditional engine. At the same mass flow rate the heated and humidified saturated airflow for expansion process has lower density, than density of the traditional engine. As a result, the volume flow rate of the working fluid through expansion process increases, thus elevating its power.

Power generation using enthalpy difference gradient and SRPE proposed herein is a new alternative or non-conventional green technology for efficient producing power by a piston engine, which uses air as a resource of renewable energy through the unique indirect evaporative cooling process.

Today's market strongly needs to have the simple, cheap and clean piston engines for producing power generation, especially for transport and car industries, using renewable energy as air.

In a further embodiment, power generation using enthalpy difference gradient and SRPE may help solving this challenge by employing on the aforementioned processes for heat recovery (heat regeneration) for producing mechanical energy with a maximal thermal efficiency and minimum pollution.

In one aspect, SRPE is configured to convert heat provided in the form of an enthalpy differential to a mechanical form of energy. The SRPE comprises a unique humidifying air recuperator through the M-Cycle, which has name «M-Regenerator». The M-Regenerator includes a heat and mass exchanger which contains the dry, wet and product channels. This heat and mass exchange apparatus through the unique indirect evaporative cooling process is created the huge (maximum possible) enthalpy difference gradient for airflows as a driving force for producing power by a piston engine. The M-Regenerator recovers a sensible and latent heat from a hot airflow after an expansion process of engine, cooling and dehumidifying this air before introducing thereof into a compression process. Simultaneously this M-Regenerator heats up and humidifies of the saturated airflow before introducing thereof into an expansion process.

Thereby the ambient environment as outside air induces to increase a rate of the phase transition through the M-Cycle evaporative cooling process that causes the big enthalpy difference gradient through the ambient environment. That's why the thermal efficiency of the SRPE is about 70%, which is far superior to all known piston power engines.

In one aspect, a subatmospheric regenerative piston engine works through the M-Regenerator by continuous cycling of water, by evaporating it into airflow as the working fluid before its expansion process while condensing it from the working fluid before its compression process. This cycling of water is kind of like a heat pipe that evaporates and condenses the working fluid. In both cases energy is efficiently transferred from one source to another through evaporation and condensing. High enthalpy through high humidity for airflow increases of the thermal efficiency for its expansion process, and, on the contrary, small enthalpy through small humidity for airflow increases of the thermal efficiency for its compression process. Enthalpy difference gradient (or difference of humidity) of the working fluid through the M-Regenerator is a driving force for the proposed subatmospheric regenerative piston engine.

The present invention has the additional advantage for a subatmospheric regenerative piston engine (SRPE). It provides for reduction of the peak combustion temperature and nitrogen oxides (NOx) and carbon monoxide (CO) levels, when as the source of heat uses a fuel or natural gas. The burning process in SRPE is dramatically improved due to high moisture content of the water vapor in airflow, after its coming through the humidifying air recuperator (or M-Regenerator). It is creating a more even burning process during combustion inside of the gas or fuel burner.

Humidification of airflow through the M-Regenerator creates the perfect conditions as oxidant for natural gas burning process, which greatly influences for the combustion kinetics and harmful substances formation. It was experimental confirmed by Gas Institute of NASU, Kiev, Ukraine, that using the wet combustion process through the M-Cycle, the NOx (NO) issue is dramatically reduced by 10.3 times and CO concentration is reduced by 1.95 times (see a paper: Soroka B., Zgurskyi V., «CFD MODELING OF TRANSFER PROCESSES AND OF POLLUTANTS FORMATION BY PREMIXED COMBUSTION THE NATURAL GAS WITH HUMIDIFIED AIR (BY MEANS OF MAISOTSENKO CYCLE)», *Modern Science Collection of Research Paper*, No 3 (5), 2010, pp. 1-6). Significantly reducing nitrogen oxides and carbon monoxide becomes a side benefit for reducing of pollution of outside air without using of expensive filters or catalytic converters. Also power efficiency of the combustion engine is increased as well.

Unlike with the conventional combustion heating technologies, the heat from exhaust gases through the M-Regenerator will not be wasted to the atmosphere but will be returned back to the piston engine, which the thermal efficiency can be increased by the present invention.

Also, the present invention provides the improved subatmospheric regenerative piston engine, which eliminates expensive and complicated heat transfer apparatus (regenerator), and which is capable of operating at relatively low temperatures and pressures, using cheap and light-weight materials.

The embodiments of the invention implement very efficient heat recovery processes through the M-Regenerator, which utilizes a unique indirect evaporative cooling process, employing the M-Cycle, by evaporating water to air. It helps to recover a greater possible amount of the sensible and latent heat and water from the exhaust gas after the expansion process, which is sucked by the compression process and compressed to atmospheric pressure and discharged to atmosphere as a product stream with parameters (temperature and humidity), approaching lower parameters of the atmosphere. It minimizes heat losses of the inventive regenerative piston engine.

As a result, almost all heat, which was brought by solar energy or/and burned fuel for to the inventive regenerative piston engine, is utilized for producing additional mechanical energy (or electricity).

Herewith finally, after passing through the M-Regenerator, it is possible to obtain the saturated airflow with a significantly high absolute humidity, and accordingly with a significantly high volumetric flow rate, before introducing thereof into the expansion process. This improves the thermal efficiency of the proposed piston engine. Simultaneously the thermal efficiency of a piston engine is increased by reducing temperature and humidity of the working fluid before its compression process below its dew point temperature or lowering its enthalpy to near the outdoor air temperature enthalpy whenever in operation. As a result, a thermal efficiency for this regenerative piston engine is more than 70% (about 75%) in comparison with traditional piston engines that operate with an efficiency of only 20%-30%.

This is accomplished by using the M-Regenerator. Also it can be realized by using the air cooler as a first stage of the M-Regenerator that preheats outside airflow while pre-cooling and pre-condensing of the working fluid before its coming to the product channel of the M-Regenerator.

In conclusion, follows to emphasize, why the thermal efficiency of the proposed subatmospheric regenerative piston engine is so high, more than 70%:

a. It is based on two working fluids: first—the high enthalpy airflow for a process of expansion and second—the small enthalpy airflow for the compression process, both operating in optimal conditions;
b. Due to very high humidity of the saturated airflow, after its passing along the wet channels, (up to 0, 5 kg vapor in 1 kg of dry air) the air-vapor blend enthalpy at the temperature of 300-400° C. is equal to the combustion gas enthalpy at the temperature of 1300-1400° C. for traditional engines. The ability to obtain a high enthalpy of the working fluid through its low temperature is a crucial factor in a significant reduction in the irreversible losses of the engine, its pollution and also cost and size;

c. Significant value of the saturated airflow enthalpy is happened due to the renewable psychrometric energy from air (ambient energy) and waste heat regeneration utilization through the M-Cycle;

d. Due to complete water condensation in the product channels after a process of expansion (thanks to approaching of the dew point temperature of outside air), the pressure drops down below the atmospheric pressure, thus providing conditions for the subatmospheric cycle;

e. Heat of condensation is transferred from the product channels to wet channels, where it is used for the more efficient water evaporation;

f. Additional water will not be needed, because the M-Regenerator constantly reclaims water from the working fluid inside of the product channels;

g. Due to application of the psychrometric energy through the M-Cycle along with higher heat regeneration rate, using heat and mass exchanger as the M-Regenerator, the proposed subatmospheric regenerative piston engine efficiency can be more than 70%.

BRIEF DESCRIPTION OF THE DRAWINGS

The present invention of power generation using enthalpy difference gradient for the subatmospheric regenerative piston engine of will be more clearly understood by reference to the following detailed description, when read in conjunction with accompanying drawing, wherein like reference characters refer to like parts throughout the several views and in which.

DETAILED DESCRIPTION

Figure 1:
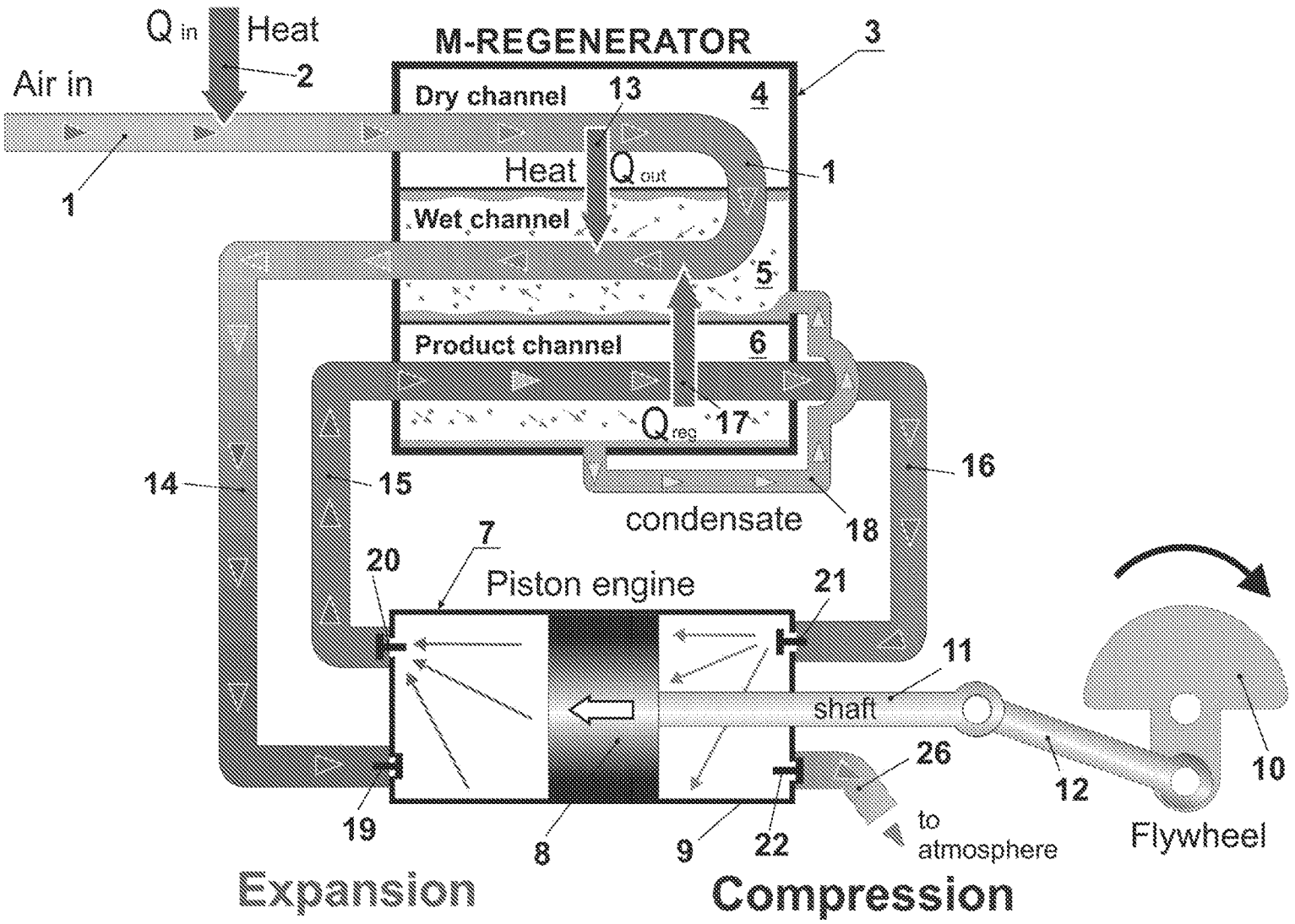
FIG. 1 is a schematic depiction of the proposed subatmospheric regenerative piston engine system.
Figure 2A:
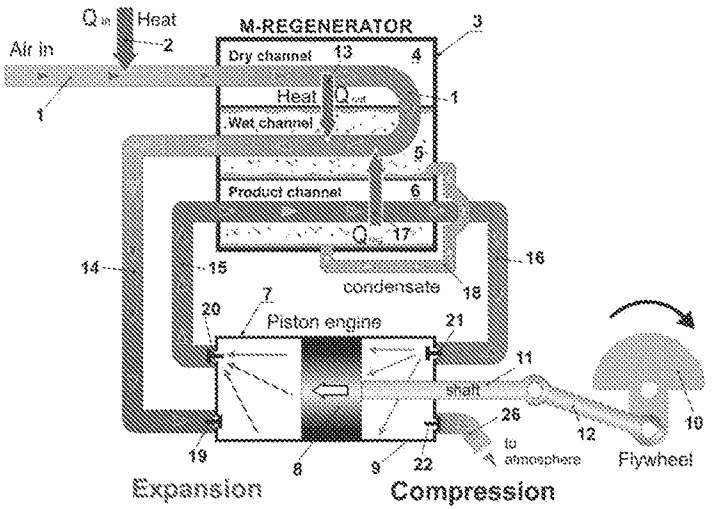
FIG. 2A-2D is show different stages in operation of the proposed subatmospheric regenerative piston engine.
Figure 2B:
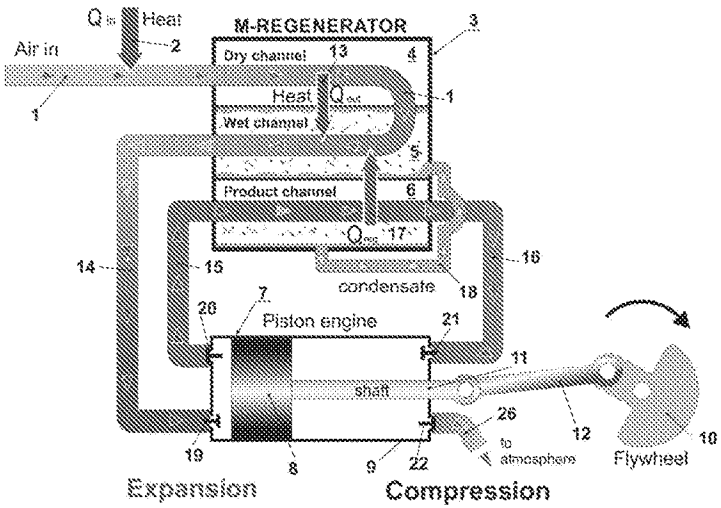
Figure 2C:
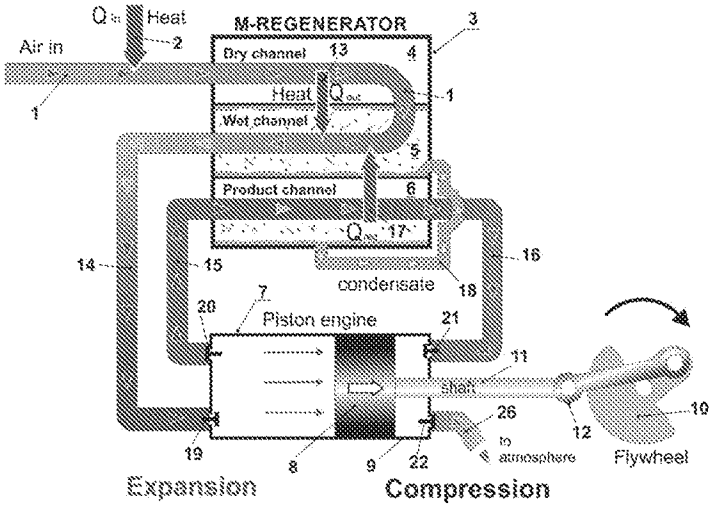
Figure 2D:
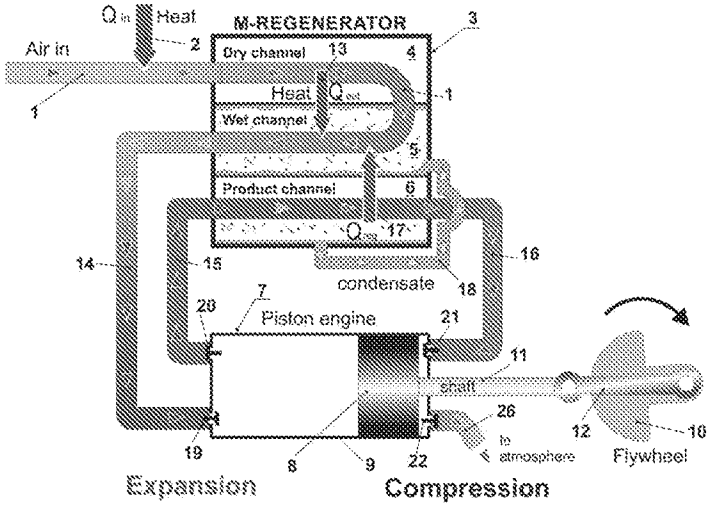

Below is a table of reference numbers and elements used in the description below.

| Reference Numeral | Element |
|---|---|
| 1 | Outside airflow in |
| 2 | Input heat Qin |
| 3 | M-Regenerator |
| 4 | Dry channel |
| 5 | Wet channel |
| 6 | Product channel |
| 7 | Regenerative piston engine |
| 8 | Piston |
| 9 | Cylinder |
| 10 | Flywheel |
| 11 | Shaft |
| 12 | Mechanism for converting the linear motion of the piston to the rotation motion of the shaft |
| 13 | Heat Qout from the dry channel to the wet channel |
| 14 | Moist and hot airflow after the wet channel |
| 15 | Moist and hot airflow coming to the product channel |
| 16 | Cold and dry airflow after coming through the product channel |
| 17 | Heat of regeneration $Q_{reg}$ from the product channel to the wet channel |
| 18 | Condensed water from the product channel and air cooler for wetting of the wet channel |
| 19 and 20 | Intake and exhaust valves for the inflow and outflow of working fluid through an expansion zone |
| 21 and 22 | Intake and exhaust valves for the inflow and outflow of working fluid through an compression zone |
| 23 | Solar air heater |
| 24 | Fluid burner |
| 25 | Auxiliary natural gas burner |
| 26 | Dry airflow which is discharged into the atmosphere |
| 27 | Air cooler |
| 28 | Pre-cooled and pre-dehumidified airflow after the air cooler |
| 29 | Finally the cold and dry airflow after the product channel in a scheme with the air cooler |
| 30 | Outside airflow coming to the air cooler |
| 31 | Pre-heated outside airflow after the air cooler which is directed to the dry channel of the M-Regenerator |
| 32 | Moist and hot airflow after the wet channel in a scheme with the air cooler |
| 33 | Moist and hot airflow coming from the expansion zone to the air cooler |

In one embodiment (see FIG. 1), the subatmospheric regenerative piston engine comprises the M-Regenerator 3 and piston engine 7 as the double-acting piston engine. The M-Regenerator 3 is the key component of this piston engine, providing very high cycle regeneration rate. The M-Regenerator 3 contains the dry 4, wet 5 and product 6 channels. Besides, any wet channel 5 is always placed between the dry 4 and product 6 channels. There is the heat exchange mechanism between these channels. Any wet working channel 5 directly connected to the dry working channel 4, the wet working channels 5 operatively form a water layer therein, the wet working channels 5 are separated from the dry working channels 4 and from the product channels 6 by a respective common heat-conducting wall thereby establishing pair-wise heat transfer relations there between; and a water line 18 connecting the bottom of the M-Regenerator 3 with the wet working channels 5. It is important to emphasize, for the proposed piston engine 7, the additional water is not needed, and because it constantly replenishes water from the exhaust working fluid during its passing along the product channels 6.

The product channels 6 are placed between an outlet of the airflow 15 from expansion zone and an inlet of the airflow 16 to compression zone of engine.

The piston engine 7 contains a cylinder 9 with a movable piston 8, which is connected to a power output shaft 11 by an appropriate mechanism 12 for converting the linear motion of the piston 8 to the rotating motion of the shaft 11.

Referring to FIG. 1, a cylinder 9 has the cylinder expansion zone (left side) with an intake 19 and exhaust 20 valves for the inflow and outflow of working fluid through an expansion zone. Also a cylinder 9 has compression zone (right side) with an intake 21 and an exhaust valves 22, which are provided for the inflow and outflow of working fluid through a compression zone.

Consider the direction and order of movement for airflow as the working fluid in the proposed engine. Operation of the engine of FIG. 1, in accordance with the present invention, begins when an airflow 1 as the working fluid, supplied from the outside, has heat exchange contact with the input heat 2 ($Q_{in}$), wherein the airflow 1 increases its temperature, and, thereafter it is directed at first into the dry channel 4, and next into the wet channel 5 of the M-Regenerator 3. Then the airflow 1 is heated and moisturized therein and further as the saturated airflow 14 with high enthalpy it is drawn and directed for expansion process through the intake valve 19 to the expansion zone of a piston engine 7 (left side), where a pressure below the atmospheric pressure. After some actions inside of a cylinder 9 of an engine 7 (see description of these actions below) the working fluid as airflow 15 is directed through the exhaust valve 20 to the product channel 6 of the M-Regenerator 3. Later this airflow as the dry and cold airflow 16 with small enthalpy is focused for compression process through the intake valve 21 to the compression zone of a piston engine 7 (right side). After some actions inside of a cylinder 9 (see description of these actions below) this airflow as airflow 26 is discharged through the exhaust valve 22 into the atmosphere.

Consider different stages (processes) in operation of the proposed subatmospheric regenerative piston engine 7 (see FIGS. 2A-2D). For convenience of description, the engine operation will begin with the compression process of the working fluid in the cylinder 9 (see FIG. 2A).

The working fluid as the heated and moisturized airflow 15 (see FIG. 2A) is pushed from expansion zone of a cylinder 9 to the product channel 6 of the M-Regenerator 3 and in this an exhaust valve 20 is opened. Passing along the product channel 6 the heated and moisturized airflow 15 is cooled and dehumidified approaching the dew point temperature of outside air. During this process the heat of regeneration 17 ($Q_{reg}$) is transferred from the product channel 6 to the wet channel 5. At the same time, the pressure behind the piston 8 (right side) decreases, the intake valve 21 is opened. The intake valve 19 and exhaust valve 22 are closed.

The fully heated and moisturized saturated airflow 15 (see FIG. 2B) is driven to the product channel 6 of the M-Regenerator 3 with following its cooling and dehumidification, which leads to reduction of enthalpy of airflow 15. After the working fluid as the cold and dry airflow 16 with small enthalpy is directed through the intake valve 21 to the compression zone of a cylinder 9 behind (right side) of the piston 8. This leads to the maximum pressure drop (differential pressure) in front (left side) and behind (right side) of the piston 8. The exhaust valve 20 and intake valve 21 are open; the intake valve 19 and exhaust valve 22 are closed.

This process (see FIG. 2C) produces the useful work. The intake valve 19 is opened and the new portion of the working fluid as outside airflow 1 is directed at first through the dry 4 and after wet 5 channels. Then this working fluid as the heated and moisturized saturated airflow 14 with high enthalpy is directed through the intake valve 19 to the expansion zone (left side) of a cylinder 9.

Passing along the dry channel 4 the working fluid is cooled approaching the dew point temperature of outside air. During of this process the heat 13 (Qout) is transferred from the dry channel 4 to the wet channel 5. After passing through the dry channel 4 the same cooled airflow 1 is directed concurrently to the wet channel 5, where it is heated, moistened by water. Next it is drawn as the saturated airflow 14 with high enthalpy by a piston 8 to the expansion zone of a cylinder 9 of an engine 7. Herewith the exhaust valve 20 is closed. A piston 8 starts to move from a left side (expansion zone) to a right side (compression zone) for direction of the downward pressure (or enthalpy), transmitting mechanical energy to flywheel.

The driving force for a piston 8 movement is the enthalpy difference gradient which was created by the working fluid on both sides of the piston 8. On the left side of the piston 8 is brought the high enthalpy of the airflow 14 on the right side of the piston 8 simultaneously is brought the low enthalpy airflow 16. The intake valve 21 is opened and the exhaust valve 22 is closed.

There is a moment (see FIG. 2D) when the pressure in front of and behind the piston 8 is aligned; herewith the intake valve 21 is closed. The exhaust valve 22 opens and begins the release of the working fluid as the exhaust airflow 26 into the atmosphere. The intake valve 19 is open, and the exhaust valve 20 is closed.

Then all four processes described above are repeated in the same sequence.

A higher air humidity ratio and temperature of the airflow 14 (see FIG. 1), which is directed from the wet channel 5 through the intake valve 19 to a cylinder 9 for expansion process, reduces its density that enhances the thermal efficiency of this gas expansion process.

Thereafter, the working fluid from the expansion zone of the regenerative piston engine 7, as the moist and hot airflow 15, is directed through the exhaust valve 20 for cooling and dehumidifying to the product channels 6 of the M-Regenerator 3. Therein, the saturated airflow 15, at a predetermined low pressure is cooled below the wet bulb temperature and it approaches the dew point temperature of outside air with reducing its absolute humidity. This low temperature helps condensing vapor of water 18 from the airflow 15. Consequently, moisture contained in the airflow 15 is condensed and the quantity of the airflow 15 decreases. Herewith density of the airflow 15 increases. After (see FIG. 1), the working fluid as the airflow 16 is directed through the intake valve 21 to the compression zone of a cylinder 9. Thus, a power necessary for driving of the piston 8 for compression process is reduced by increasing of density and reducing quantity of the airflow 15, which as the airflow 16 is directed to a cylinder 9 for compression process.

Water 18 extracted from the airflow 15 is drained and recovered. The condensable cold water 18 is directed by a water line from the product channel 6 for wetting of the wet channels 5. Therefore, additional water will not be needed for operating the M-Regenerator 3, because it constantly liberates water from the airflow 15. The line for the condensed water 18 can include a condensate separator for cleaning some polluting condensate components and additional replenishing of water, if it is necessary.

The cooling and dehumidifying processes for the airflow 15 inside of the product channel 6 result in a reduction of volume of the airflow 15 inside the product channels 6. This substantially increases the density of the airflow 15 supplied as the airflow 16 into the compression zone of a cylinder 9. It increases the efficiency of operating of compression process, when a piston 8 is moving inside of cylinder 9 from a left side to a right side.

After passing through the product channels 6 (see FIG. 1), the working fluid as the airflow 16 is coming into the compression zone of a cylinder 9, compressed to the atmospheric pressure by a piston 8 (during its moving from a left side to a right side) and discharged into the atmosphere through the exhaust valve 22 as the airflow 26. This provides effective cooling and dehumidifying processes for the working fluid reducing its enthalpy, when the airflow 16 passes through the product channels 6. A piston 8, during its moving from a left side to a right side, compresses the cold and dry airflow 16 which enthalpy is lesser. Thereby pressure of the airflow 16 is rising therein to the atmospheric pressure. Herewith the exhaust valve 22 is opened, and the working fluid as the airflow 26 is ejected through the exhaust valve 22 into the atmosphere.

The process of extraction of the sensible and latent heat of regeneration 17 ($Q_{reg}$) from the moist and hot airflow 15 (see FIG. 1), during its passing through the product channels 6, is used to heat and humidify the outside airflow 1, during its passing through the wet channels 5. Condensed water 18 from the airflow 15 inside the product channels 6 adds a significant amount of heat of regeneration 17 ($Q_{reg}$), which transfers from the product channel 6 to the wet channels 5 of the M-Regenerator 3. It is important to consider that it takes 1 Btu to cool one pound of water at 1° F. and 1040 Btu to condense that same one pound of water vapor. Adding the latent heat has a significant effect on the thermal efficiency of the proposed piston engine.

As described above (see FIG. 1), the outside airflow 1 before was preheated by the input heat 2 ($Q_{in}$) and thereafter, as the working fluid, is at first passed through the dry channels 4 and next into the wet channels 5. Next the heated and moisturized working fluid with high enthalpy as the saturated airflow 14 is drawn from the M-Regenerator 3 through the intake valve 19 to the expansion zone of a piston engine 7 (left side), where a pressure is below the atmospheric pressure.

During the passing through the wet channels 5, the working fluid significantly increases its absolute humidity and temperature, and consequently increases its the enthalpy, due to of the sensible and latent heat of regeneration 17 ($Q_{reg}$), which is transferred from the product channel 6 to the wet channel 5 of the M-Regenerator 3. It is important emphasize that absolute humidity of the airflow 14, after its passing along the wet channel 5, is always more than that obtainable from any other known methods of humidifying. The increased humidity and temperature raises the volumetric flow rate of the working fluid through the expansion process of the piston engine7. A higher volume of the airflow 14 means that there is more air to force a piston 8 to move a greater distance, and thereby increasing its power output through the embodiments of the invention.

The suggested invention of power generation, using enthalpy difference gradient for the subatmospheric regenerative piston engine of FIG. 1, offers a significant improvement in the thermal efficiency of producing power (more than 70%). It is possible to get high thermal efficiently for the proposed piston engine 7 only due to using of the M-Regenerator 3 together with this piston engine, as this is shown on FIG. 1. It gives an opportunity to dehumidify and cool (approaching the dew point temperature of outside air) the working fluid, which is directed as the airflow 16 from the product channel 6 with small enthalpy for compression process through the intake valve 21 into the compression zone of a cylinder 9. It increases their power output and efficiencies. Simultaneously the working fluid as the airflow 14 is humidified and heated prior to its extension through extension zone of the piston engine 7, where it with high enthalpy is directed from the wet channel 5 for expansion process via the intake valve 19 to expansion zone of a cylinder 9. It also increases their power output and efficiencies. Moreover, both these processes for the airflow 16 (with small enthalpy) and airflow 14 (with high enthalpy) are realized more effectively than traditional evaporative cooling and humidifying processes, and are effected using only one apparatus as the M-Regenerator 3.

Thereby the M-Regenerator 3 is the unique heat and mass exchanger which through the M-Cycle realizes the best heat recovery process. The M-Regenerator 3 effectively ensures the production of the two air streams 14 and 16 as the working fluids, which the enthalpy difference gradient is significant value, and that it is a driving force for the production of mechanical energy by the proposed piston engine 7. Moreover, this enthalpy difference gradient increases exponentially with increasing temperature of the input heat 2 ($Q_{in}$).

Since the traditional power engines have the high-temperature and high-pressure working fluids, it is difficult to recover power from unused, high-temperature or atmospheric exhaust gases produced by manufacturing processes by the old-style power engine cycles. It is reason why the costs of the heat recovery are intolerably high.

As stated above, the M-Regenerator 3 is used in the proposed subatmospheric regenerative piston engine, wherein the heating and mass recovery processes are effected at the atmospheric pressure. It significantly improves all characteristics of the M-Regenerator 3 as well as the whole piston engine 7. This atmospherically supplied M-Regenerator 3 and the whole piston engine 7 are preferred as an engine for motorcycle or car industries and also in the residential or commercial setting, being due to their much lower cost, simplicity of design, and ease of maintenance. It is also noted that most of existing power engines typically have material problems, since the materials, they are built from, not only don't satisfactorily withstand high pressures, but also don't withstand high pressures at high temperatures, particularly in stack gases and combustion products, which tend to be corrosive. An effort to overcome these problems usually results in solutions involving considerable expenses, rendering power plants inefficient. The proposed subatmospheric regenerative piston engine 7 of FIG. 1 operates with lower pressures at lower temperatures, which solves these problems and provides this piston engine 7, incorporating the M-Regenerator 3, for being more efficient and inexpensive.

Figure 3:
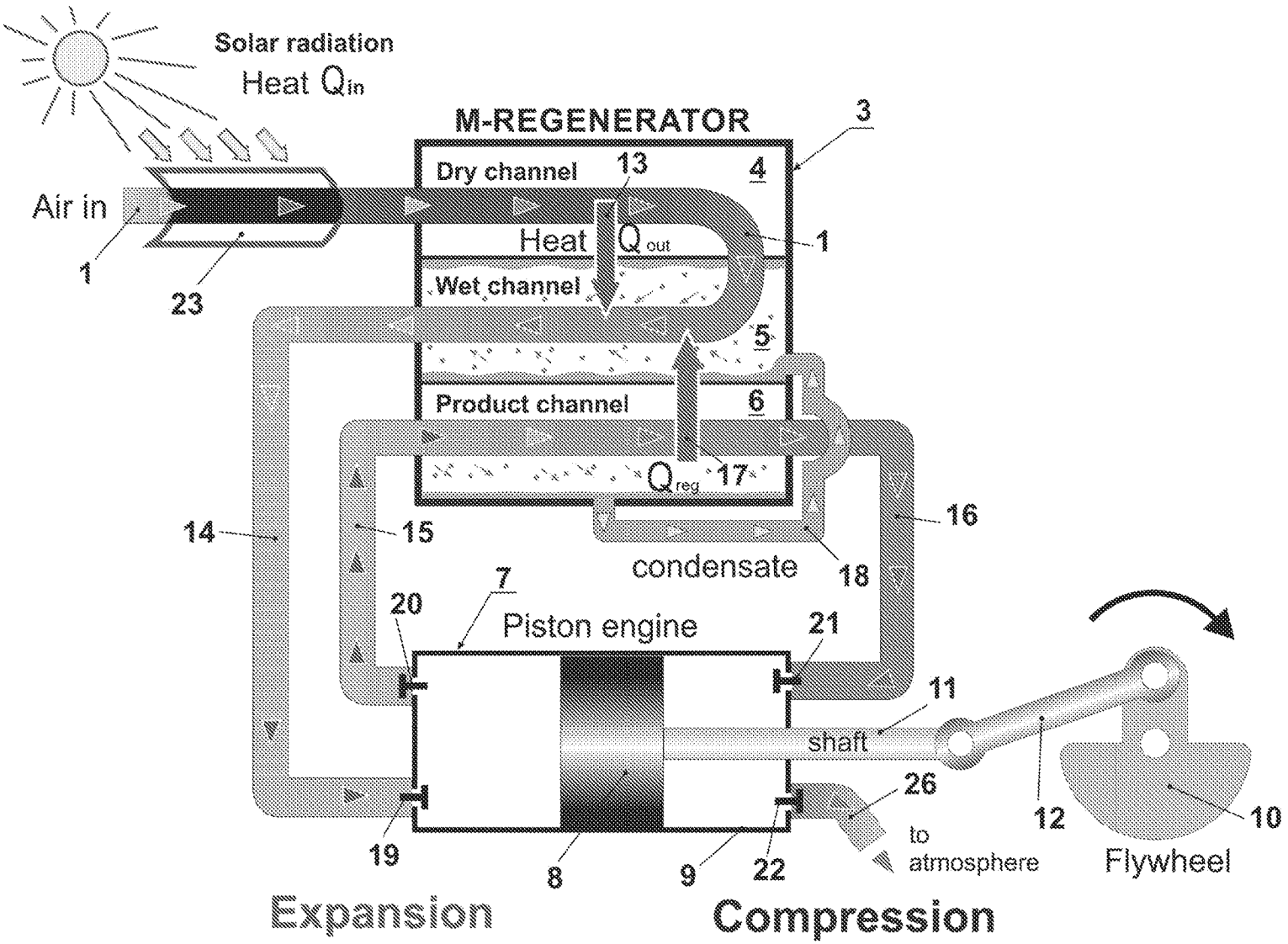
FIG. 3 is a schematic depiction of the proposed subatmospheric regenerative piston engine system which contains the solar air heater 23 as a source of heat.

FIG. 3 illustrates yet another embodiment of the inventive of power generation using enthalpy difference gradient for the subatmospheric regenerative piston engine, similar to the illustrated on FIGS. 1 and 2, in which contains the solar air heater 23 as a source of heat.

With the advent of the energy crisis there has been substantial emphasis placed on the utilization of renewable energy sources, such as solar heat. One of the principal problems associated with effective utilization of solar heat has been the cost of storing significant quantities of such heat that is the cost of a heat accumulator for use during non-daylight hours or during extended periods, when the sun was obscured by cloudy or overcast skies. Indeed, the high cost of construction of the existing storage systems has minimized the effective utilization of solar heat.

It is also noted that existing solar heat accumulators, such as solar air heaters of the existing solar power systems and engines, which are used to realize the Brayton, Diesel, Otto or combine cycles, have significant material problems, since the materials do not typically withstand high pressures. Existing solar heat accumulators, such as solar air heaters for transforming the concentrated solar radiation energy to a high pressure air are complex, expensive and excessively sized. An effort to overcome these problems usually results in solutions involving considerable cost penalties, so that efficient solar power systems and engines remain unavailable to the general public. The proposed subatmospheric regenerative piston engine, and its element as the solar air heater 23 (see FIG. 3), operates with lower pressures, and resolves these problems and provides a more efficient and inexpensive solar thermally driven power system incorporating the piston engine 7.

The traditional solar air heater has typically comprised a device for transferring the concentrated solar radiation energy to a high temperature/high pressure air as by means of a relatively complex heat exchanger. The high pressure air, in turn, is expanded through a high pressure turbine or piston. However, these power systems and engines have not been widely used because of the complexity and expense of the high pressure solar heat exchanger, together with the required relatively large sizes of the heat exchanger.

The proposed subatmospheric regenerative piston engine comprises the improved the solar air heater 23 with a high thermal efficiency, which also eliminate expensive and complicated heat transfer apparatuses, and which are capable of operating at relatively low temperatures and pressures, using inexpensive and light-weight materials.

The solar air heater 23 (shown in FIG. 3) captures heat from the sun by the outside airflow 1 supplied there into, and transfers through the M-Regenerator 3 this heat by the working fluid as the moist and hot airflow 14 with high enthalpy to the piston engine 7. In general, the solar air heater 23 comprises an interior space, a glazing surface oriented to the sun, a plate which absorbs solar radiation and converts it into heat, and intake and discharge passages for a circulating heat-transfer fluid as outside air 1. The solar air heater 23 is said to be air-based because for this proposed subatmospheric regenerative piston engine the heat transfer fluid is air. A system as a whole is said to be active if it utilizes a device for compelling circulation of air, rather than relying on natural convection.

In a solar air heater of any type, there are, of course, time periods, during which the solar energy is not sufficiently absorbed to provide the necessary quantity of heat for the particular power engine. Therefore, an auxiliary heating system is normally provided in combination with the solar air heating system. The source of auxiliary heat supply is a major problem. It depends on the field of application of the proposed piston engine. For motorcycle or car industries it is rational to use the liquid fuel or balloon gas, propane, and the like for the auxiliary heating system. For residential or commercial setting it is normal to use energy from a commercial utility grid, either pipeline natural gas or electricity which can be available at a uniform price. Preferably, the withdrawal of energy from a gas pipeline may be made at any time a demand exists.

Figure 4:
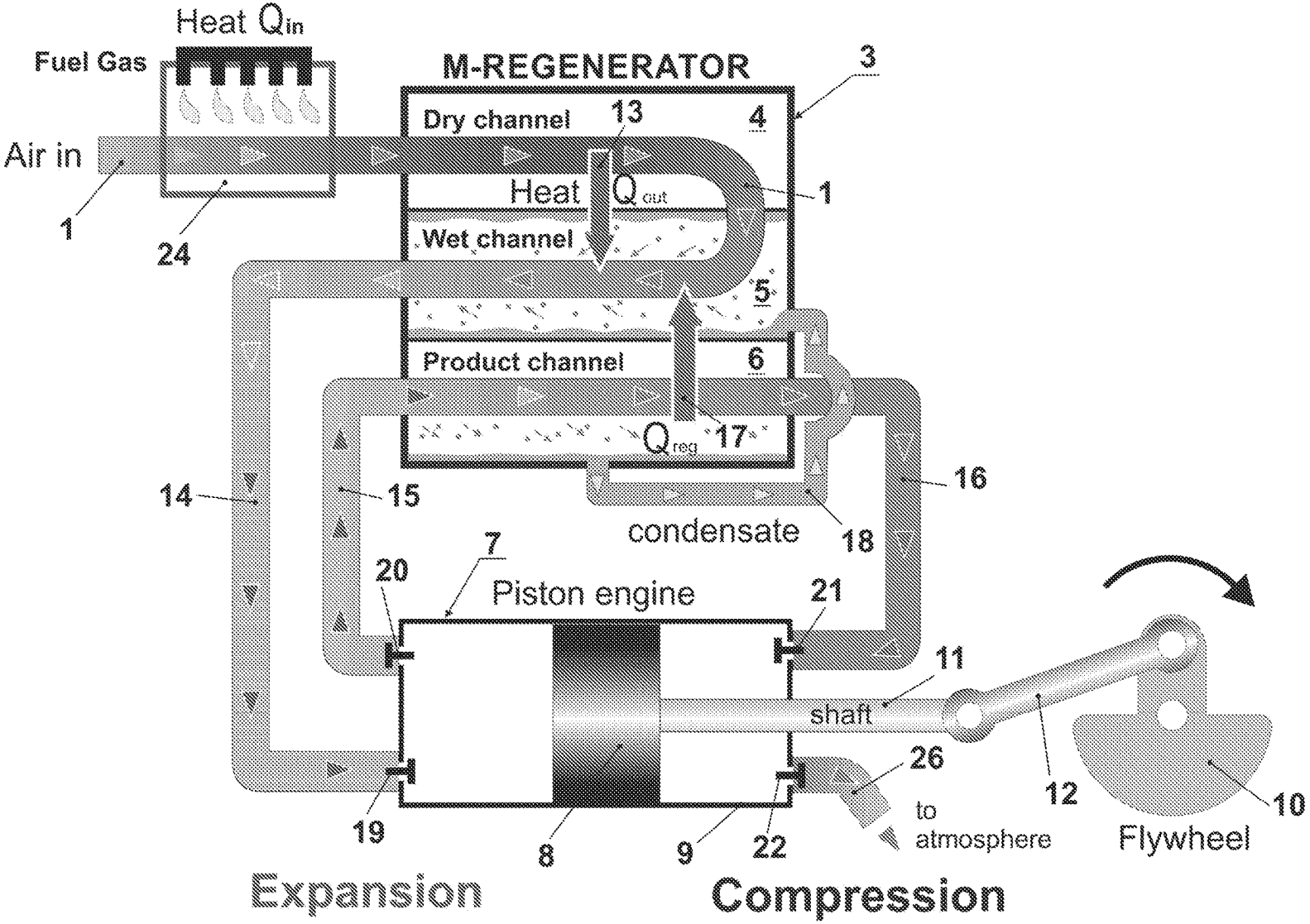
FIG. 4 is a schematic depiction of the proposed subatmospheric regenerative piston engine system which contains the fluid burner 24 as a source of heat.

FIG. 4 is a schematic depiction of the proposed subatmospheric regenerative piston engine system which contains the fluid burner 24 as a source of heat that may optionally use any type of fuel.

All existing combustion power engines as the internal combustion piston engines or a gas turbine engines are used the fuel (gas or liquid) which is supplied for combustion process under high pressure. An atmospheric combustion for existing power engines is impossible and heat of the atmospheric exhaust gas cannot be used. Thus, all existing combustion power engines have difficulties in using various gaseous or liquid fuels, solid fuels and unused high-temperature gases. It is structurally impossible for these engines to reduce emission of heat from the system by circulating the exhaust gas, which is disadvantageous with respect to the thermodynamic cycle. As mentioned above, in a conventional power engines, the pressurized fuel must be supplied to the combustor or burner because the pressure in the combustor is high. It is the reason why the costs of the burner systems are intolerably high.

In the proposed subatmospheric regenerative piston engine (shown in FIG. 4), a fluid burner 24 is used, wherein the combustion or burning processes are provided at the atmospheric pressure. It significantly improves all characteristics of the fluid burner 24. This is due to their much lower costs, simplicity of design, and ease of maintenance.

Figure 5:
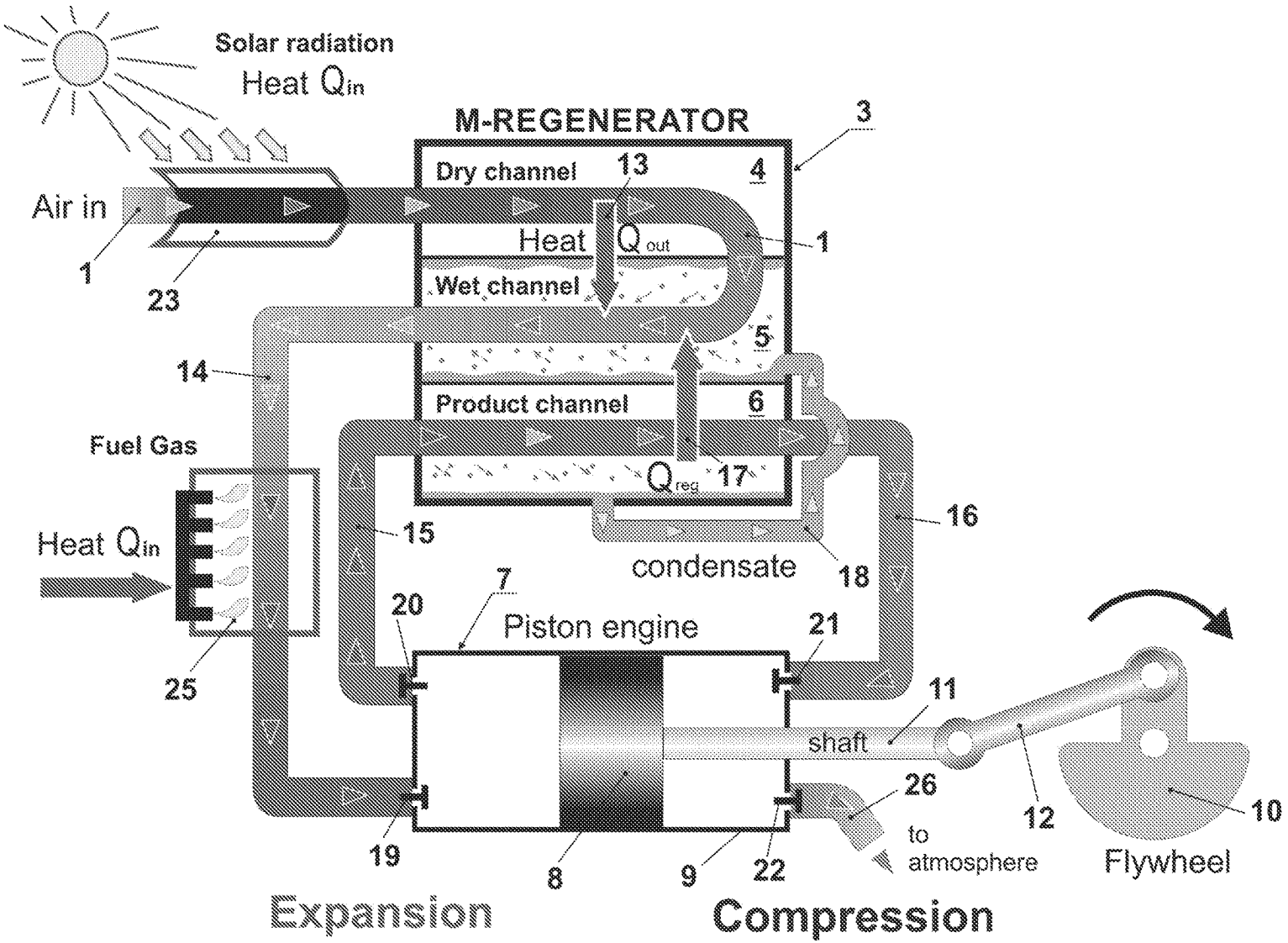
FIG. 5 is a schematic depiction of the proposed subatmospheric regenerative piston engine system which contains the solar air heater 23 and auxiliary natural gas burner 25 as a source of heat.

Sometimes it is rational to use for the proposed subatmospheric regenerative piston engine two source of heat. FIG. 5 shows an embodiment of the suggested engine, which comprises two source of heat: (1) solar air heater 23, and (2) auxiliary natural gas burner 25. Together with natural gas, it is possible to use any kind of gas, liquid or solid fuel, for example, gasoline, kerosene, coal, bio fuel, wood and etc. Accordingly, for any kind of fuel it is used for a fit design of the combustion chamber. Today, natural gas is the best popular fuel for the stationary conditions and gasoline for transport. Also, this power system comprises required valves (they don't show). It provides for an opportunity for this engine to selectively work in different thermal modes, using (a) only solar air heater 23, or (b) only auxiliary natural gas burner 25, or (c) together the solar air heater 23 and auxiliary natural gas burner 25.

Since the natural gas input as fuel of the atmospheric pressure is fed into the auxiliary natural gas burner 25 without increasing the pressure of fuel, the proposed subatmospheric regenerative piston engine does not need any fuel compressor or pump.

It is important emphasized that auxiliary natural gas burner 25 (see FIG. 5) can be designed for heating process for the working fluid through as direct and as indirect ways. It can be the direct combustion chamber, where the exhaust gas after combustion process is mixing with the working fluid through the direct contact. In this case the combustion process is more efficient because not loses of heat and whole heat of combustion is transferred for the working fluid. Disadvantage of this technology is contamination of the working fluid. Using the indirect heating process through heat exchange surface for the working fluid, it is possible not pollute of the working fluid. But in this case the combustion process is less efficient, because some part of the heat is lost by removing of the exhaust gases to the atmosphere. For proposed subatmospheric regenerative piston engine it is possible to use both technologies.

Sometimes it is rational to use the auxiliary natural gas burner 25 with direct heating process for the working fluid. A higher air humidity ratio and temperature of the airflow 14, which enters to the auxiliary natural gas burner 25, creates a lower density of the airflow 14 by growing its volumetric flow rate through its increasing of temperature and humidity. It is better for the efficiency of the expansion process inside of a cylinder 9, when the moist and hot airflow 14 from the auxiliary natural gas burner 25 is directed through the intake valve 19 to the expansion zone of the piston engine 7.

Raising of temperature and humidity of the airflow 14, which is directed to the auxiliary natural gas burner 25 (see FIG. 5), requires less heating of the air fuel mixture, and is therefore more efficient. What is more surprising is that adding humidity to the airflow 14 will also reduce the fuel needed. The added humidity increases the mass flow of the input airflow 14 at a higher temperature requiring less fuel to heat this airflow 14 before its coming to the expansion zone of the piston engine 7.

Water vapor has other positive effects. For example, it comprises polyatomic molecules (three atoms $H_2O$ as opposed to two atoms like $O_2$ or $N_2$), that can radiate and be radiated to. This ability to radiate reduces hot spots in the burning process of the auxiliary natural gas burner 25 giving more complete burning with about half the amount of $NO_x$, an endothermic or energy draining reaction. This is similar to but better than an existing automobile engine that uses a small amount of exhaust gas recirculation or $CO_2$ plus $H_2O$ recirculation to lower its $NO_x$. The higher efficient burning at lower temperatures also decreases the carbon monoxide (CO) in the same way as reducing $NO_x$.

Using the auxiliary natural gas burner 25 with direct heating process for the proposed piston engine 7, pollution is dramatically (at times) reduced due to the water vapor of the moist and hot airflow 14 creating a more even burning process inside of the auxiliary natural gas burner 25 during the combustion. For example, the most toxic pollution from combustion process NO ($NO_x$) issue is reduced by 10.3 times and [CO] concentration is reduced by 1.95 times (see a paper by B. Soroka et al.: "DEVELOPMENT OF CONPUTATION TECHNIQUES AND DATA GENERALIZATION ON BURNING VELOCITY OF DRY AND HUMIDIFIED INFLAMMABLE GAS FUEL-OXIDANT MIXTURES", International Journal of Energy for a Clean Environment, Volume 12, p. 187-208, 2012).

The M-Regenerator 3 tends to be the most expensive single component in the proposed subatmospheric regenerative piston engine that is equipped therewith. The M-Regenerator 3 extracts through the M-Cycle the sensible and latent heat of regeneration 17 ($Q_{reg}$) from the product channel 6 (where the working fluid as airflow 15 is passing through) to the wet channel 5 (where the working fluid as airflow 1 is passing through). The M-Regenerator 3 provides an indirect evaporative cooling process through the M-Cycle having efficient wicking action, allowing easy wetting of the surface area of the wet channels 5 without excess water (which would cool the water rather than the air).

After passing through the solar air heater 23 (see FIG. 5), the working fluid as airflow 1 is directed at first to the dry channels 4, and next to the wet channels 5 of the M-Regenerator 3, and thereafter it as the moist and hot airflow 14 is sent off to the auxiliary natural gas burner 25.

Only the above described procedure and sequence of processes of the proposed piston engine ensures its high engine thermal efficiency and lower fuel consumption by the auxiliary natural gas burner 25.

Sometimes it is rational to realize two stage cooling and dehumidifying processes for the working fluid, before it is directed with small enthalpy through the intake valve 21 for the compression process of an engine 7.

The air psychrometric saturation line slopes such that cool air has a greater change in energy for a given humidity ratio change than at higher temperatures. This means that in the M-Regenerator 3 there will be more condensation than evaporation, producing the condensed water 18 from water vapor of airflow 15, which is passing along the product channel 6. It is desirable to maintain a balance between the evaporative and condensing processes as condensate amount in the product channel 6 was close to the amount of evaporated water in the wet channel 5. This allows for getting of maximum efficiency of the heat recovery process for the M-Regenerator 3, and it means the maximum thermal engine efficiency for the proposed piston engine. For this purpose, it is desirable sometimes to implement a pre-condensation process, using additional apparatus as the air cooler, which will help to comply with regulation of evaporation and condensation balance through the M-Regenerator 3. Because using the M-Regenerator 3 there will be more condensation than evaporation, it expedient to realize the pre-condensing process for airflow before its coming to the product channel 6 of the M-Regenerator 3.

Figure 6:
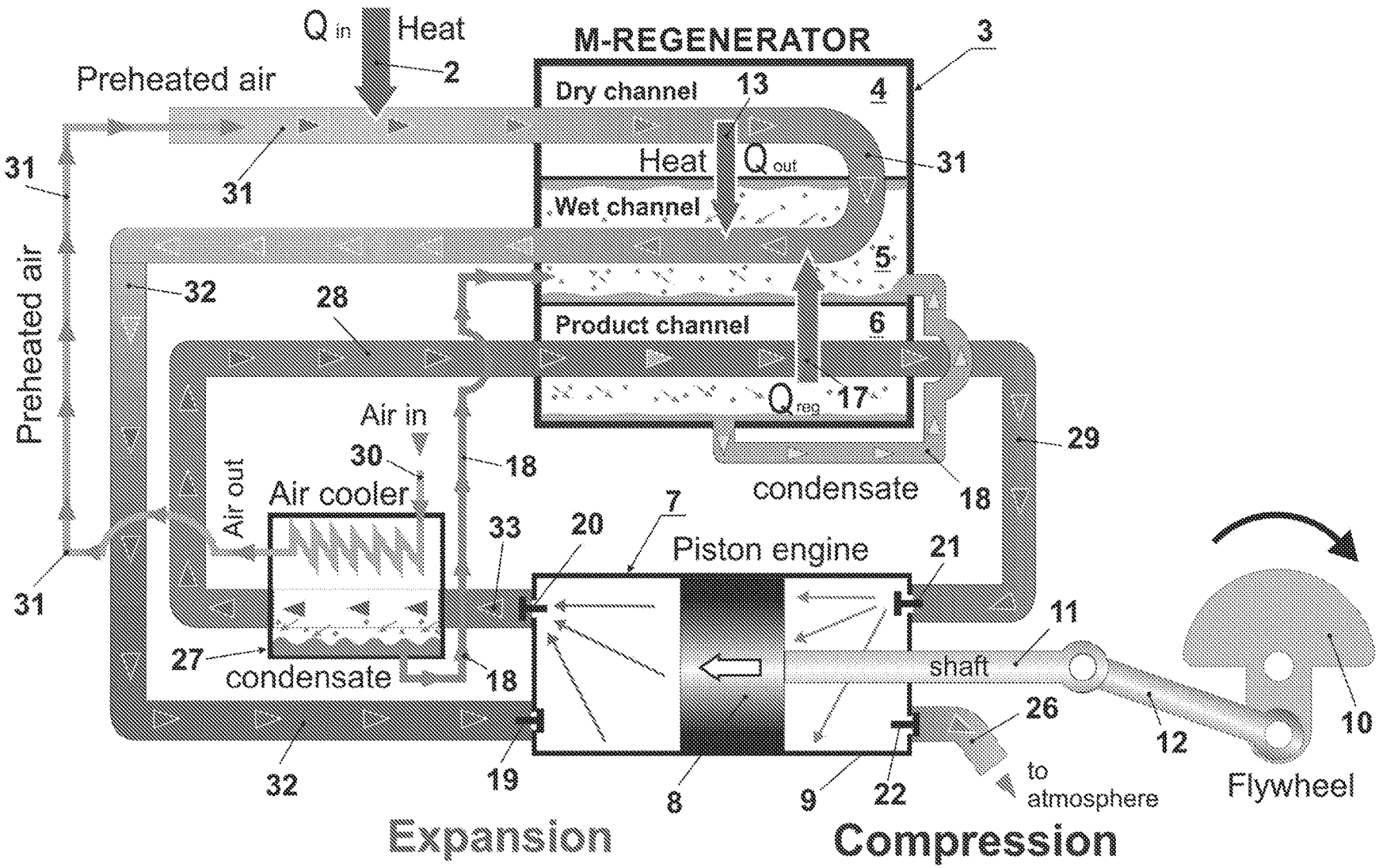
FIG. 6 is a schematic depiction of the proposed subatmospheric regenerative piston engine system which contains the air cooler 27 for preliminarily pre-cooling and pre-dehumidifying of the working fluid after it is pushed from expansion zone.

FIG. 6 is a schematic depiction of the proposed subatmospheric regenerative piston engine system which contains the additional air cooler 27 for preliminarily pre-cooling and pre-dehumidifying of the working fluid, before it is pushed to the product channel 6 of the M-Regenerator 3.

As the air cooler 27 it is possible to use any kind of a heat exchange apparatus, which can realize the indirect heat exchange process between outside air 30 and the moist and hot airflow 33 coming via the exhaust valve 20 from the expansion zone of the piston engine 7. Because temperature and absolute humidity of outside air 30 is always less than temperature and absolute humidity of the moist and hot airflow 33, last, after passing through the air cooler 27, reduces its temperature and absolute humidity. In connection with this outside air 30, after passing through the air cooler 27, increases its temperature due to the selection of the sensible and latent heat flux from the moist and hot airflow 33. After, the working fluid as the preheated airflow 31 (see FIG. 6) is directed from the air cooler 27 through heating by input heat 2 ($Q_{in}$) to the dry channel 4 of the M-Regenerator 3. Before its coming to the dry channel 4 airflow 31 has heat exchange contact with the input heat 2 ($Q_{in}$), wherein the airflow 31 increases its temperature, and, thereafter it is directed at first into the dry channel 4, and next into the wet channel 5 of the M-Regenerator 3. In this case amount of the necessary input heat 2 ($Q_{in}$), which we have to spend for heating of airflow 31, will be less because before airflow 31 was preheated during its passing through the air cooler 27. Thereby using the air cooler 27 it gives the opportunity not only to improve the performance of the M-Regenerator 3, but it also is provided an opportunity to recovery some part of sensible and latent heat from the moist and hot airflow 33. It also increases the efficiency of the proposed piston engine.

The moist and hot airflow 33, after passing through the air cooler 27, reduces its temperature and absolute humidity by cooling of the colder outside air 30. This low temperature of the available outside air 30 helps partly condensing vapor of water 18 from the airflow 33. Consequently, moisture contained in the airflow 33 partly is condensed and the quantity of the airflow 33 decreases. After, the working fluid (see FIG. 6) as the pre-cooled and pre-dehumidified airflow 28 is directed from the air cooler 27 to the product channel 6 of the M-Regenerator 3 for its final cooling and dehumidification. Later the cold and dehumidified working fluid as the airflow 29 is sendoff through the intake valve 21 for the compression process of a piston engine 7.

The condensed water 18 is directed by a water line from the air cooler 27 for wetting of the wet channels 5 of the M-Regenerator 3. Thereby in this case (see FIG. 6) the drain condensed water 18 can come for wetting of the wet channels 5 from two sources: water 18 condensed from the airflow 33 in the air cooler 27; and water 18 condensed from the airflow 28 in the product channel 6 of the M-Regenerator 3. Therefore, additional water will not be needed for wetting of the wet channels 5 of the M-Regenerator 3, because it constantly liberates water from the airflows 33 and 28. The lines for condensed water 18 can include a condensate separator for cleaning some polluting condensate components and additional replenishing of water, if it is necessary.

Due to very high humidity of the saturated airflow1, after its passing along the wet channels 5, (up to 0, 5 kg vapor in 1 kg of dry air) the air-vapor blend enthalpy at the temperature of 300-400° C. is equal to the combustion gas enthalpy at the temperature of 1300-1400° C. for traditional engines. The ability to obtain a high enthalpy of the working fluid through its low temperature is a crucial factor in a significant reduction in the irreversible losses of the proposed piston engine, its pollution and also cost and size.

Thus, the proposed power generation method and regenerative piston engine provide very high thermal efficiency (more than 70%) at relatively low air-vapor flow temperature (but high enthalpy). It opens the principal opportunity of the proposed piston engines development operating without organic fuel. It is possible to use for these engines only the solar air heater 23 (see FIG. 3) without the chemical fuel energy, abandoning of the auxiliary natural gas burner 25 (see FIG. 5). Instead, only solar and psychrometric energy, as two kinds of renewable energy, can be used, as well as various industrial waste heat sources.

Also it gives unique opportunity to create the new kind of the efficient solar cars using the existing low temperature solar air heater (as a source of the heat energy instead of fuel) through the proposed piston engines.

What is claimed is:

1. A subatmospheric regenerative engine comprising:

an M-regenerator including:

at least one dry channel capable of operatively receiving an outside airflow and passing thereof in a first direction forming an intermediate airflow;

at least one wet channel, adjacent to the at least one dry channel, and capable of passing the intermediate airflow in a second direction opposite to the first direction, thereby forming a saturated hot airflow, further acting as a first working fluid;

at least one product channel, adjacent to the at least one wet channel;

a first heat-conducting wall separating the at least one dry channel from the at least one wet channel, thereby establishing a first heat transfer therebetween; and a second heat-conducting wall separating the at least one wet channel from the at least one product channel, thereby establishing a second heat transfer therebetween;

a water pipeline connecting a bottom of the at least one product channel with the at least one wet channel capable of operatively drawing water condensate from the at least one product channel to the at least one wet channel and forming a water layer therein;

a pipeline A disposed outside the M-regenerator, and capable of operatively receiving the first working fluid from the at least one wet channel;

a pipeline B disposed outside the M-regenerator, and capable of operatively receiving the outside airflow;

a source of heat capable of heating up the outside airflow in the pipeline B before drawing the outside airflow into the at least one dry channel;

a pipeline C disposed outside the M-regenerator, and capable of passing the first working fluid to the at least one product channel, thereby forming a second working fluid therein;

a pipeline D disposed outside the M-regenerator, and capable of passing the second working fluid from the at least one product channel;

a double-acting piston engine including:

a cylinder;

a piston capable of operatively dividing the cylinder into a compression zone and an expansion zone, said piston is capable of reciprocal motion within the cylinder thereby producing said mechanical power, and said piston is coupled with a shaft capable of outputting the mechanical power from the piston engine;

an intake expansion valve mounted in the cylinder and capable of controllably connecting said pipeline A with said expansion zone, thereby passing the first working fluid therethrough;

an exhaust expansion valve mounted in the cylinder and capable of controllably connecting said expansion zone with said pipeline C, thereby passing the first working fluid therethrough;

an intake compression valve mounted in the cylinder and capable of controllably connecting said pipeline D with said compression zone, thereby passing the second working fluid therethrough; and an exhaust compression valve mounted in the cylinder and capable of controllably connecting said compression zone with the atmosphere, thereby passing the second working fluid therethrough.

2. A method for production of mechanical power by the subatmospheric regenerative engine according to claim 1, said method comprising the steps of:

(a1) introducing the outside airflow essentially at atmospheric pressure into said pipeline B;

(b1) heating up the outside airflow having a temperature and an absolute humidity in said pipeline B by the source of heat, thereby obtaining the intermediate airflow in the at least one dry channel; passing the intermediate airflow through at least one dry channel reducing the temperature approaching a corresponding dew point temperature without changing the absolute humidity and pressure of the intermediate airflow;

(c1) providing the first heat transfer from the at least one dry channel to the at least one wet channel having a wetted surface;

(d1) due to the first heat transfer, heating and humidifying the intermediate airflow in the at least one wet channel thereby producing the first working fluid having a pressure essentially equal to atmosphere pressure, and further directing the first working fluid into the pipeline A;

(e1) controllably inputting the first working fluid from said pipeline A into said expansion zone through the intake expansion valve;

(f1) by the pressure of the first working fluid, providing a movement of the piston, increasing the expansion zone and decreasing the compression zone, whereas the pressure of said first working fluid is reduced below atmospheric pressure;

(g1) providing a return movement of the piston, increasing the compression zone and decreasing the expansion zone, and controllably outputting the first working fluid from the expansion zone into said pipeline C through the exhaust expansion valve and further into the product channel;

(h1) providing the second heat transfer from the at least one product channel to the at least one wet channel;

(i1) due to the second heat transfer, cooling the first working fluid approaching a corresponding dew point temperature and dehumidifying the first working fluid in said at least one product channel, forming a water condensate therein and reducing pressure inside said at least one product channel, thereby forming the second working fluid therein having a pressure below atmospheric pressure;

(j1) directing the second working fluid into said pipeline D;

(k1) controllably inputting the second working fluid from said pipeline D into the compression zone through the intake compression valve, wherein the second working fluid is sucked into the compression zone and compressed to atmosphere pressure;

(l1) controllably outputting the second working fluid from said compression zone into the atmosphere through the exhaust compression valve; and (m1) cyclically repeating the steps (a1)-(l1), providing said reciprocal motion of the piston and the shaft, and thereby producing said mechanical power.

3. The subatmospheric regenerative engine according to claim 1, wherein said source of heat is provided in the form of solar radiation, or hydrocarbon fuel, or a combination thereof.

4. The subatmospheric regenerative engine according to claim 1, wherein said source of heat is provided in the form of solar radiation; said subatmospheric regenerative engine further comprising an auxiliary natural gas burner having a combustion chamber mounted such that at least a part of said pipeline A extends within and through the combustion chamber.

5. The subatmospheric regenerative engine according to claim 4, wherein the combustion chamber provides for a direct heating process including production of exhaust gas further mixed with the first working fluid.

6. The subatmospheric regenerative engine according to claim 4, wherein a heat transfer is provided from the combustion chamber to the pipeline A, extending within and through the combustion chamber, via a surface of the pipeline A, thereby additionally heating up the first working fluid passing through said pipeline A.

7. A subatmospheric regenerative engine comprising:

an M-regenerator including:

at least one dry channel capable of operatively receiving a heated airflow and passing thereof in a first direction forming a second airflow;

at least one wet channel, situated below the at least one dry channel, and passing the second airflow in a second direction opposite to the first direction, thereby forming a saturated airflow further acting as a first working fluid;

at least one product channel, situated below the at least one wet channel;

a first heat-conducting wall separating the at least one dry channel from the at least one wet channel, thereby establishing a first heat transfer therebetween; and a second heat-conducting wall separating the at least one wet channel from the at least one product channel, thereby establishing a second heat transfer therebetween;

a first water pipeline connecting a bottom of the at least one product channel with the at least one wet channel operatively drawing water condensate from the at least one product channel to the at least one wet channel and forming a water layer therein;

a pipeline A disposed outside the M-regenerator, and capable of operatively receiving the first working fluid from the at least one wet channel;

a source of heat for heating up a preheated airflow, forming the heated airflow;

an air cooler capable of operatively receiving outside airflow; said air cooler defines at least an internal space and an air duct disposed within the internal space; wherein a third heat transfer is established between the internal space and the air duct; the air duct is capable of passing the outside airflow therethrough, thereby forming the preheated airflow; and the internal space is capable of passing the first working fluid therethrough, thereby pre-cooling and pre-dehumidifying the first working fluid;

a second water pipeline connecting the internal space with the at least one wet channel, operatively drawing water condensate from the air cooler to the at least one wet channel;

a pipeline B disposed outside the M-regenerator, connecting the air cooler and the at least one dry channel, capable of operatively receiving said preheated airflow from the air cooler, and passing said preheated airflow to the source of heat;

a pipeline C disposed outside the M-regenerator, connecting the air cooler and the at least one product channel, and capable of passing the first working fluid from the air cooler to the at least one product channel, wherein the first working fluid is finally cooled and dehumidified, thereby forming a second working fluid;

a pipeline D disposed outside the M-regenerator;

a double-acting piston engine including:

a cylinder;

a piston operatively dividing the cylinder into a compression zone and an expansion zone, said piston is capable of reciprocal motion within the cylinder thereby producing said mechanical power, and said piston is coupled with a shaft capable of outputting the mechanical power from the piston engine;

an intake expansion valve mounted in the cylinder and capable of controllably connecting said pipeline A with said expansion zone and operatively passing the first working fluid from the at least one wet channel to the expansion zone;

an exhaust expansion valve mounted in the cylinder, capable of controllably connecting said expansion zone with said air cooler and operatively passing the first working fluid to the internal space of said air cooler;

an intake compression valve mounted in the cylinder, capable of controllably connecting said pipeline D with said compression zone and introducing said second working fluid into the compression zone; and an exhaust compression valve mounted in the cylinder and capable of controllably connecting said compression zone with the atmosphere, thereby outputting the second working fluid into the atmosphere.

8. A method for generation of mechanical power comprising the steps of:

(a) providing a double-acting piston engine including a cylinder, and a piston capable of reciprocal motion within the cylinder and operatively dividing the cylinder into a compression zone and an expansion zone;

(b) providing an outside airflow;

(c) heating up the outside airflow;

(d) passing the outside airflow having a first temperature and an absolute humidity through at least one dry channel reducing the first temperature approaching a dew point without changing the absolute humidity, forming an intermediate airflow;

(e) passing the intermediate airflow through at least one wet channel;

(f) providing a first heat transfer between the at least one dry channel and the at least one wet channel;

(g) simultaneously, in the at least one wet channel, humidifying the intermediate airflow and heating the intermediate airflow due to the first heat transfer, thereby obtaining the first working fluid characterized with atmospheric pressure and a first enthalpy rate;

(h) controllably inputting the first working fluid into said expansion zone, wherein the first working fluid is expanded, thereby reducing pressure of the first working fluid below atmospheric pressure;

(i) providing a second heat transfer between at least one product channel and the at least one wet channel;

(j) controllably outputting the first working fluid from said expansion zone into the at least one product channel, cooling the first working fluid, due to the second heat transfer, approaching a temperature of dew point, dehumidifying the first working fluid, thereby forming a water condensate in the at least one product channel;

(k) in the at least one product channel, obtaining a second working fluid characterized with a second enthalpy rate below the first enthalpy rate; thereby establishing an enthalpy difference gradient between the first working fluid and the second working fluid;

(l) controllably inputting the second working fluid from the at least one product channel into said compression zone, wherein the second working fluid is sucked into said compression zone;

(m) compressing the second working fluid to atmosphere pressure in said compression zone, and controllably outputting the second working fluid from said compression zone into the atmosphere; and (n) cyclically repeating the steps (b)-(m), thereby producing said mechanical power.

* * * * *